US008743159B2

(12) United States Patent
Fukase

(10) Patent No.: US 8,743,159 B2
(45) Date of Patent: Jun. 3, 2014

(54) DISPLAY DEVICE WITH GRAY SCALE PROCESSING CIRCUIT TO PROCESS LOWER GRAY SCALE LEVEL

(75) Inventor: Daisuke Fukase, Tokyo (JP)

(73) Assignee: Lapis Semiconductor Co., Ltd., Tokyo (JP)

( * ) Notice: Subject to any disclaimer, the term of this patent is extended or adjusted under 35 U.S.C. 154(b) by 194 days.

(21) Appl. No.: 13/303,574

(22) Filed: Nov. 23, 2011

(65) Prior Publication Data

US 2012/0133684 A1 May 31, 2012

(30) Foreign Application Priority Data

Nov. 29, 2010 (JP) ..... 2010-265008

(51) Int. Cl.
*G09G 5/10* (2006.01)

(52) U.S. Cl.
USPC ..... 345/690

(58) Field of Classification Search
USPC ..... 345/690, 204
See application file for complete search history.

(56) References Cited

U.S. PATENT DOCUMENTS

| | | | | |
|---|---|---|---|---|
| 7,629,970 | B2 * | 12/2009 | Oura | 345/204 |
| 2003/0231195 | A1 * | 12/2003 | Ueno et al. | 345/698 |
| 2004/0155891 | A1 * | 8/2004 | Kang | 345/690 |
| 2005/0105115 | A1 * | 5/2005 | Hoshi | 358/1.9 |
| 2006/0274021 | A1 * | 12/2006 | Park et al. | 345/100 |
| 2009/0041348 | A1 * | 2/2009 | Someya et al. | 382/167 |
| 2011/0234644 | A1 * | 9/2011 | Park et al. | 345/690 |

FOREIGN PATENT DOCUMENTS

| | | |
|---|---|---|
| JP | 05-108026 | 4/1993 |
| JP | 07-219493 | 8/1995 |
| JP | 10-268836 | 10/1998 |
| JP | 2003-288058 | 10/2003 |

* cited by examiner

*Primary Examiner* — William Boddie
*Assistant Examiner* — Bipin Gyawali
(74) *Attorney, Agent, or Firm* — Volentine & Whitt, PLLC

(57) ABSTRACT

A display device includes a gray scale controller which adjusts the number of pieces of image data successively displayed at the same brightness level to a predefined value or less when a desired brightness level represented by input image data is equal to or less than a predetermined level. Alternatively the display device may include a gray scale controller which may make the frequencies of selection of an immediately lower display brightness level than a desired level and an immediately higher display brightness level closer to each other when the brightness level represented by the input image data is equal to or less than the predetermined level and other than a plurality of display brightness levels. This frequency control is done to prevent a selected display brightness level from continuing at the same level over a period greater than a predetermined cycle.

20 Claims, 3 Drawing Sheets

DISPLAY DEVICE WITH GRAY SCALE PROCESSING CIRCUIT TO PROCESS LOWER GRAY SCALE LEVEL

BACKGROUND OF THE INVENTION

1. Field of the Invention

The present invention relates to a display device, a gray scale processing circuit, and a method of gray scale processing, for performing gray scale processing to display an image on a display panel such as a liquid crystal panel.

2. Description of the Related Art

In display devices for displaying images on a display panel, the brightness levels which the display panel can display, i.e., the display brightness levels, are prescribed at certain intervals corresponding to the brightness levels of input image data for each pixel. The display brightness level is defined at intervals of one level, for example, starting from a brightness level of 0 followed by 1, 2, 3, . . . Suppose the brightness level of image data to be desired to display includes a decimal fraction, for example, a brightness level 0.50 of the image data. In this case, gray scale processing is carried out such that the frames of brightness levels 0 and 1 are alternately displayed for a certain period of time to create a brightness level of 0.50 in a pseudo manner. In the gray scale processing, for example, a slightly lower display brightness level than a desired brightness level and a slightly higher display brightness level are repeatedly displayed at such a high speed that human eyes cannot follow the repetitions. In this manner, the desired brightness level of the image data is recognized by a viewer.

As shown in FIG. 1 of the accompanying drawings, a display device for gray scale processing includes a gray scale processing circuit. The gray scale processing circuit has a gray scale pattern generator circuit 1 and an adder 2. The gray scale processing circuit is supplied with input image data of eight bits indicative of a brightness level. The lower two bits of the 8-bit input image data are equivalent to the decimal places of the brightness level and supplied to the gray scale pattern generator circuit 1, and the upper six bits are supplied to the adder 2. The gray scale pattern generator circuit 1 uses the lower two bits corresponding to the brightness level of the decimal places as a gray scale level, so as to produce one-bit gray scale pattern data according to the gray scale level. The adder 2 adds the one-bit gray scale pattern data to the lowest bit of the 6-bit data and then sends the resulting 6-bit image data to a source driver (not shown).

FIG. 2A to FIG. 2C of the accompanying drawings shows the gray scale pattern data of the gray scale levels of 0.25 (the lower two bits="01"), 0.50 (the lower two bits="10"), and 0.75 (the lower two bits="11") in the gray scale pattern generator circuit 1, respectively. Specifically, the gray scale pattern data for a gray scale level of 0.25 is indicative of 0, 1, 0, 0 in the respective frames; the gray scale pattern data for a gray scale level of 0.50 is indicative of 0, 1, 0, 1 in the respective frames; and the gray scale pattern data for a gray scale level of 0.75 is indicative of 0, 1, 1, 1 in the respective frames. The gray scale pattern data is made up of four frames, and repeatedly used.

Suppose pixel data is indicative of a brightness level, for example, 1.75. This brightness level is occasionally referred to as "desired brightness level." An immediately lower display brightness level of 1 than the desired brightness level (i.e., brightness level of 1.75) and an immediately higher display brightness level of 2 are used as shown in FIG. 3 of the accompanying drawings. Specifically, the brightness levels of the display panel are controlled in four frames so as to become as the lower display brightness level 1, the higher display brightness level 2, the higher display brightness level 2, and the higher display brightness level 2 in the four frames, respectively.

SUMMARY OF THE INVENTION

For image data of a low brightness level, one may visually perceive a greater difference between the pixel brightness of the display panel which is actually attained at an immediately lower display brightness level and the pixel brightness of the display panel which is actually attained at an immediately higher display brightness level. As can be seen from the properties shown in FIG. 4 of the accompanying drawings, this happens because the display brightness difference corresponding to the difference between display brightness levels of input data to the display panel is visually perceived to be greater in a region of low brightness (a brightness difference of $\Delta 1$) than in a region of higher brightness (a brightness difference of $\Delta 2$). Accordingly, when the above-described gray scale processing is performed for image data of a low brightness level, the difference in visual pixel brightness between the lower and higher display brightness levels may cause flicker on the display screen.

Methods for preventing flicker are implemented, for example, in some conventional display devices which are disclosed in Japanese Patent Application Publication (Kokai) No. 5-108026, Japanese Patent Application Publication No. 7-219493, Japanese Patent Application Publication No. 10-268836, and Japanese Patent Application Publication No. 2003-288058. However, the conventional display devices had another problem that they had to go through processing in a complicated manner.

One object of the present invention is to provide a display device which carries out gray scale processing in a simple manner without causing flicker on a display screen.

Another object of the present invention is to provide a gray scale processing circuit for use in such display device.

Still another object of the present invention to provide a method of gray scale processing which performs gray scale processing in a simple manner without suffering from flicker on a display screen.

According to one aspect of the present invention, there is provided a display device that includes a gray scale processing unit which successively displays two or more pieces of image data having different brightness levels in a predetermined order on a display panel during a predetermined period, thereby displaying in a pseudo manner a brightness corresponding to a desired brightness level represented by input image data. The display device includes a detection unit for determining whether the desired brightness level is equal to or less than a predetermined level. The display device also includes a gray scale controller. When the desired brightness level is equal to or less than the predetermined level, the gray scale controller adjusts the number of successively displayed pieces of image data at the same brightness level to a predefined value or less.

According to another aspect of the present invention, there is provided a method of gray scale processing to successively display two or more pieces of image data having different brightness levels in a predetermined order on a display panel during a predetermined period, thereby displaying in a pseudo manner a brightness corresponding to a desired brightness level. The method includes the step of detecting (or determining) whether the desired brightness level is equal to or less than a predetermined level, and the step of adjusting the number of successively displayed pieces of image data at the same brightness level to a predefined value or less when the desired brightness level is equal to or less than the predetermined level.

According to still another aspect of the present invention, there is provided a display device that displays on a display panel an image corresponding to input image data. To this end, the display device selects in predetermined cycles either an immediately lower display brightness level than a brightness level represented by the input image data or an immediately higher display brightness level, among a plurality of display brightness levels defined at equal intervals, for each pixel of the display panel. Then, the display device drives the display panel at the selected display brightness levels, and performs gray scale processing, whereby the brightness level represented by the image data is produced in a pseudo manner. The display device includes a detector for detecting that the brightness level represented by the image data is equal to or less than a predetermined level and other than said plurality of display brightness levels. The display device also includes a gray scale controller for making the frequencies of selection of the immediately lower display brightness level and the immediately higher display brightness level closer to each other when the brightness level represented by the image data is equal to or less than the predetermined level and other than said plurality of display brightness levels. This is done so that the selected display brightness levels do not continue (or stay) at the same display brightness level for a period greater than the predetermined cycle.

According to yet another aspect of the present invention, there is provided a gray scale processing circuit. To display an image corresponding to input image data on a display panel, the gray scale processing circuit is configured to select in predetermined cycles either an immediately lower display brightness level than the brightness level represented by the input image data or an immediately higher display brightness level, among a plurality of display brightness levels defined at equal intervals, for each pixel of the display panel. The brightness level represented by the image data is thus produced in a pseudo manner. The gray scale processing circuit includes a detector for detecting that the brightness level represented by the image data is equal to or less than a predetermined level and other than said plurality of display brightness levels. The gray scale processing circuit also includes a gray scale controller for making the frequencies of selection of the immediately lower display brightness level and the immediately higher display brightness level closer to each other to prevent the selected display brightness levels from staying at the same display brightness level for a period greater than the predetermined cycle when the brightness level represented by the image data is equal to or less than the predetermined level and other than said plurality of display brightness levels.

According to another aspect of the present invention, there is provided a method of gray scale processing for displaying an image corresponding to input image data on a display panel of a display device. The display device selects in predetermined cycles either an immediately lower display brightness level than the brightness level represented by the input image data or an immediately higher display brightness level, among a plurality of display brightness levels defined at equal intervals, for each pixel of the display panel. Then, the display device drives the display panel at the selected display brightness levels to produce the brightness level represented by the image data in a pseudo manner. The method includes the step of detecting (determining) that the brightness level represented by the image data is equal to or less than a predetermined level and other than said plurality of display brightness levels. The method also includes the step of making the frequencies of selection of the immediately lower display brightness level and the immediately higher display brightness level closer to each other to prevent the selected display brightness levels from staying at the same display brightness level for a period greater than the predetermined cycle when the brightness level represented by the image data is equal to or less than the predetermined level and other than said plurality of display brightness levels.

In an exemplary embodiment of the present invention, the number of pieces of image data to be successively displayed at the same brightness level is adjusted to a predefined value or less when the desired brightness level is equal to or less than a predetermined level. In another embodiment, the frequencies of selection of an immediately lower display brightness level and an immediately higher display brightness level are made closer to each other, so that the selected display brightness levels does not stay at the same display brightness level for a period greater than the predetermined cycle even when the brightness level represented by the image data is in a low brightness region at a predetermined level or less. Embodiments of the present invention may be implemented in a simple configuration. It is thus possible to perform gray scale processing while preventing flicker on the display screen in a simple configuration.

DETAILED DESCRIPTION OF THE INVENTION

Now, embodiments of the present invention will be explained below in more detail with reference to the accompanying drawings.

Figure 5:
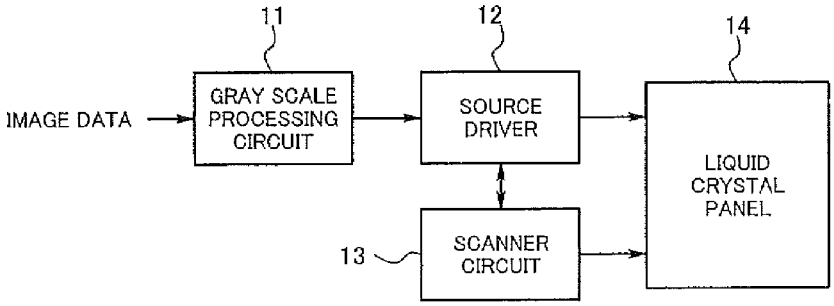
FIG. 5 is a block diagram of a display device according to one embodiment of the present invention.

Referring first to FIG. 5, a display device according to one embodiment of the present invention will be described. The display device includes a gray scale processing circuit 11, a source driver 12, a scanner circuit 13, and a matrix liquid crystal panel 14. The gray scale processing circuit 11 is supplied with input image data indicative of the brightness level of each pixel of the liquid crystal panel 14. The image data is made up of eight bits which represent the brightness level of each of pixels for a still image. In this embodiment, the 8-bit data is supplied to the gray scale processing circuit 11 in the predetermined order of pixels. The six higher bits of the eight bits are indicative of a brightness level represented by a value preceding a decimal point, while the two remaining lower bits are indicative of a brightness level represented by a value following the decimal point.

Figure 6:
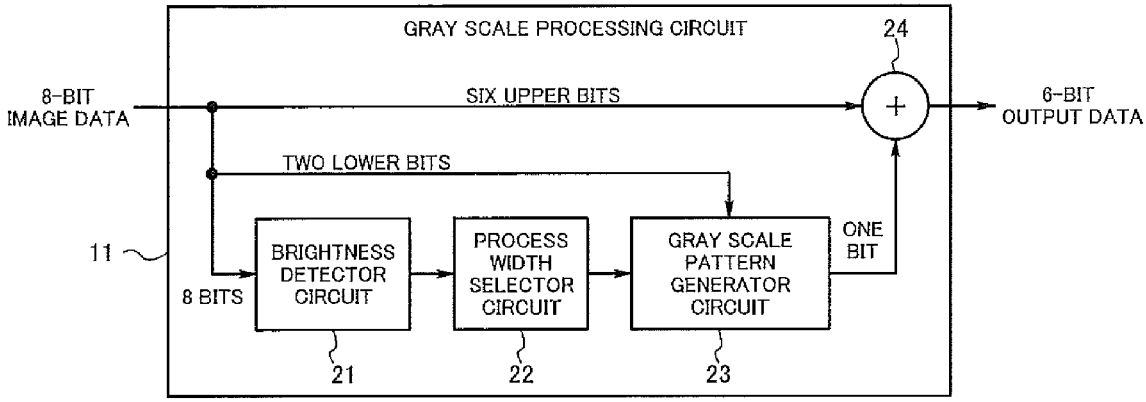
FIG. 6 is a block diagram of a gray scale processing circuit in the display device shown in FIG. 5.

As shown in FIG. 6, the-gray scale processing circuit 11 includes a brightness detector circuit 21, a process width selector circuit 22, a gray scale pattern generator circuit 23, and an adder 24.

Figure 4:
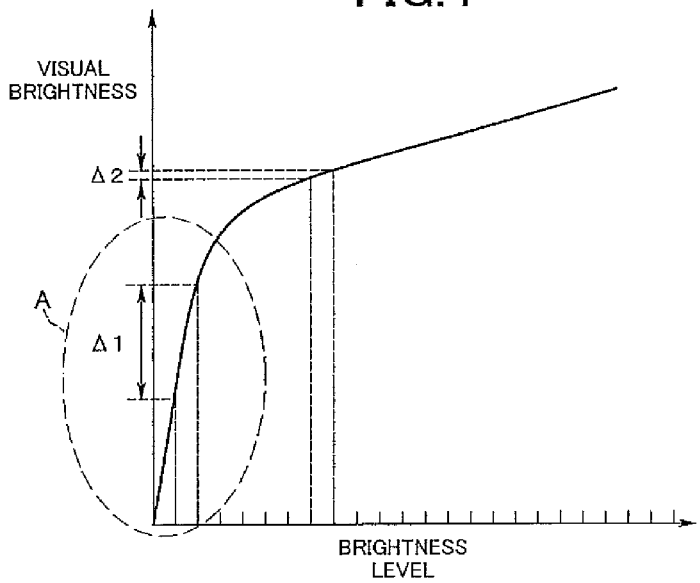
FIG. 4 illustrates the visual brightness characteristic versus the brightness level.

The brightness detector circuit 21 serves as the detector to determine whether the brightness level represented by the 8-bit image data is no greater than a predetermined level. The predetermined level is in a low-brightness range shown by symbol A in FIG. 4, and is the threshold value between one region and the remaining regions. In this "one region," the difference between actual display brightnesses is visually felt to be greater than the difference between the display brightness levels corresponding to the brightness levels of image data supplied to the liquid crystal panel. It should be noted that the low-brightness range differs depending on the characteristics of the liquid crystal panel, and the predetermined level may be changed depending on the properties of the liquid crystal panel to be employed.

The process width selector circuit 22 and the gray scale pattern generator circuit 23 constitute the gray scale controller.

The process width selector circuit 22 selects a gray scale processing width of either two bits or one bit depending on the results of detection provided by the brightness detector circuit 21. The gray scale processing width is the number of bits indicative of the gray scale level that is less than the unit of the display brightness level. If the brightness level of input image data is greater than the predetermined level, then the circuit 22 selects two bits as the gray scale processing width, whereas if the brightness level is equal to or less than the predetermined level, then the circuit 22 selects one bit as the gray scale processing width.

If the gray scale processing width selected by the process width selector circuit 22 is two bits, then the gray scale pattern generator circuit 23 uses the two lower bits of the eight bits of the image data as the gray scale level, and generates the gray scale pattern data that is represented by one bit according to the gray scale level. On the other hand, if the gray scale processing width selected by the process width selector circuit 22 is one bit, then the circuit 23 uses the seventh bit of the 8 bits of the image data (the seventh bit from the most significant bit) as the gray scale level, and generates the gray scale pattern data that is represented by one bit according to the gray scale level. Examples of the gray scale pattern data will be described later.

The adder 24 is supplied with the six higher bits of the eight bits of the input image data. The adder 24 adds each one-bit gray scale pattern data produced by the gray scale pattern generator circuit 23 to the least significant bit of 6-bit data supplied in a unit time as a plurality of pieces of input image data. As a result, the adder 24 issues 6-bit image data from its output.

The source driver 12 receives 6-bit image data for each pixel from the adder 24 to produce a drive voltage that is applied to each of column electrodes (data electrodes) of the liquid crystal panel 14. The drive voltage is a voltage that is determined for each pixel according to the 6-bit data, i.e., a voltage corresponding to brightness. The drive voltage is produced for each display line of the liquid crystal panel 14 in synchronization with the display line scanning of the liquid crystal panel 14 by the scanner circuit 13. The source driver 12 and the scanner circuit 13 are well known in the art and thus will not be further detailed here.

The gray scale processing circuit 11 is provided in the form of a single (or separate) semiconductor chip in the illustrated embodiment. It should be noted that the grays scale processing circuit 11 may be integrated with the source driver 12 or with the source driver 12 and the scanner circuit 13 in the form of a single semiconductor chip.

In the above-described display device, if the brightness level represented by the 8-bit input image data is greater than the predetermined level, the brightness detector circuit 21 supplies to the process width selector circuit 22 the detection result that the brightness level is greater than the predetermined level. Accordingly, the process width selector circuit 22 selects the 2-bit gray scale processing width, and supplies this result of selection to the gray scale pattern generator circuit 23.

Figure 1:
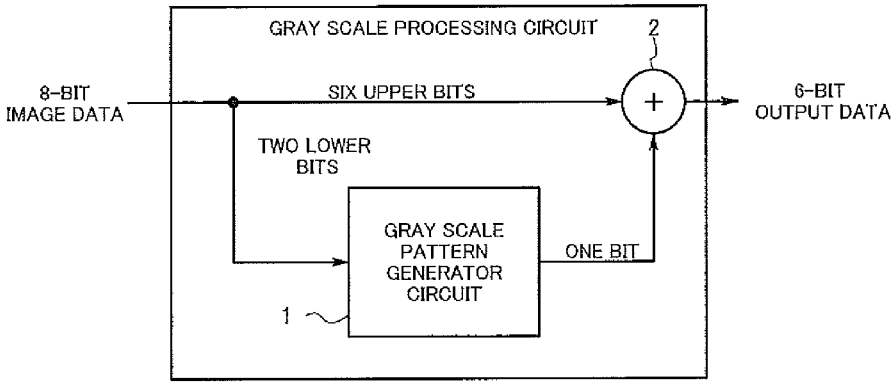
FIG.1 RELATED ART
FIG. 1 is a block diagram of a conventional gray scale processing circuit.
Figure 2A:
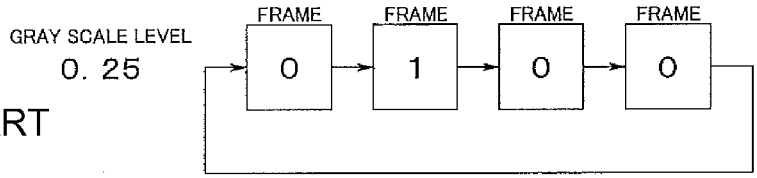
FIG.2A RELATED ART
FIG. 2A illustrates values of frames in a gray scale pattern at a lower gray scale level in the conventional circuit of FIG. 1.
Figure 2B:
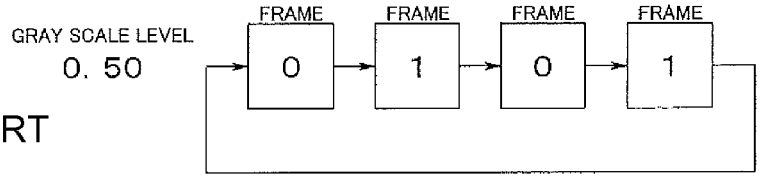
FIG.2B RELATED ART
FIG. 2B illustrates values of frames in a gray scale pattern at an intermediate gray scale level in the conventional circuit of FIG. 1.
Figure 2C:
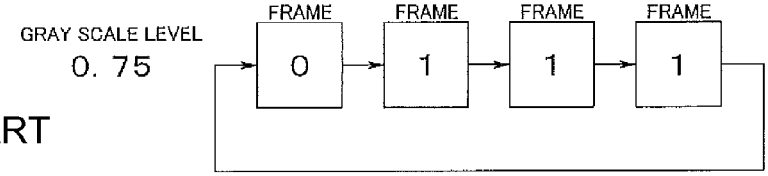
FIG.2C RELATED ART
FIG. 2C illustrates values of frames in a gray scale pattern at a higher gray scale level in the conventional circuit of FIG. 1.
Figure 3:
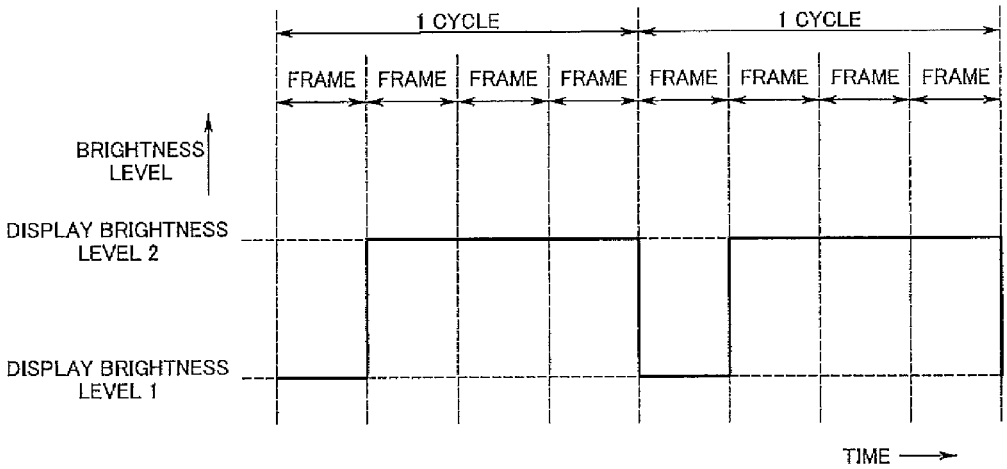
FIG.3 RELATED ART
FIG. 3 illustrates changes in the display brightness level of each frame at a brightness level of 1.75 in the conventional circuit of FIG. 1.

With the 2-bit gray scale processing width, the two lower bits of the image data are read as the gray scale level in the gray scale pattern generator circuit 23, and the gray scale pattern data of four frames is repeatedly produced according to the gray scale level. For the two lower bits="01" (gray scale level of 0.25), the produced gray scale pattern data varies as 0, 1, 0, 0 frame by frame (in a predetermined cycle). For the two lower bits="10" (gray scale level of 0.50), the produced gray scale pattern data varies as 0, 1, 0, 1 frame by frame. For the two lower bits="10" (gray scale level of 0.75), the produced gray scale pattern data varies as 0, 1, 1, 1 frame by frame. Four frames of gray scale pattern data are averaged to provide a gray scale level. These pieces of gray scale pattern data are the same as those of the pattern data shown in FIG. 2. It should be noted that for the two lower bits="00" (gray scale level of 0.00), there is no need of addition and thus no gray scale pattern data is produced.

Figure 7:
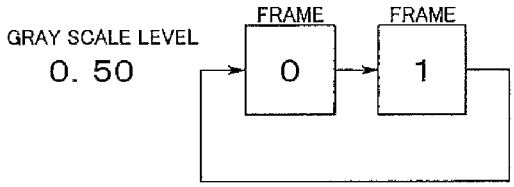
FIG. 7 illustrates values of frames in a gray scale pattern corresponding to a gray scale level in a low brightness region in the gray scale processing circuit of FIG. 6.

If the gray scale processing width is one bit, the seventh bit (one bit) of the image data is read as the gray scale level in the gray scale pattern generator circuit 23, and thus the gray scale pattern of two frames is repeatedly produced according to the gray scale level. For the seventh bit="1" (gray scale level of 0.50), as shown in FIG. 7, the produced gray scale pattern varies as 0, 1 frame by frame. The two frames of gray scale pattern is averaged to provide a gray scale level. For the seventh bit="0" (gray scale level of 0.00), the produced gray scale pattern data remains zero in each frame.

The adder 24 adds one-bit gray scale pattern data to the lowest bit of the 6-bit data supplied, and then the resulting 6-bit image data is sent to the source driver 12.

The brightness level of input image data may be greater than the predetermined level, for example, 10.75 (8 bits="00011011"). In this case, the 6-bit data generated from the adder 24 repeatedly varies frame by frame in the order of an immediately lower display brightness level of 10 (6 bits="000110") than the brightness level of 10.75, an immediately higher display brightness level of 11 (6 bits="000111"), a display brightness level of 11 (6 bits="000111"), and a display brightness level of 11 (6 bits="000111").

Figure 8:
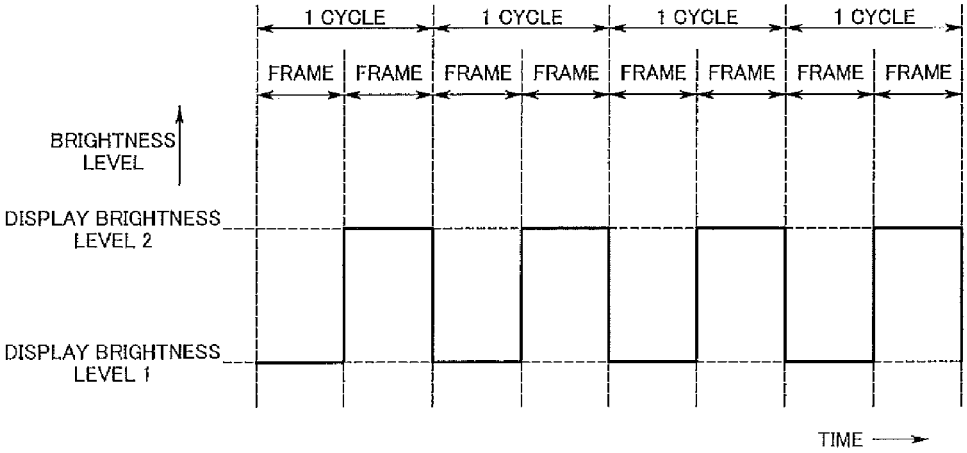
FIG. 8 illustrates changes in the display brightness level of each frame at a brightness level of 1.75 in a low brightness region in the gray scale processing circuit of FIG. 6.

On the other hand, the brightness level of the input image data may be equal to or less than the predetermined level, for example, 1.75 (8 bits="00000111"). In this case, as shown in FIG. 8, the 6-bit image data generated from the adder 24 repeats frame by frame an immediately lower display brightness level of 1 (6 bits="000001") than the brightness level of 1.75 and an immediately higher display brightness level of 2 (6 bits="000010").

As such, when the brightness level of input image data is greater than the predetermined level, the gray scale processing width is set to two bits to perform the gray scale processing in the cycle of four frames. Thus, the brightness level of the input image data can be produced in the liquid crystal panel 14 in a pseudo manner. On the other hand, when the brightness level of the input image data is equal to or less than the predetermined level, the gray scale processing width is set to one bit, and the gray scale processing is performed in the cycle of two frames. Accordingly, even if the pixel brightness corresponding to the immediately lower display brightness level than the desired level and the pixel brightness corresponding to the immediately higher display brightness level are visually felt to be greatly different from the desired brightness, the immediately lower display brightness level does not continue for two frames and the immediately higher display brightness level does not continue for two frames, i.e., the brightness varies in short(er) cycles. It is thus possible to present a pseudo brightness level through gray scale processing without a viewer perceiving it as flicker on the display screen. The illustrated display device has a simple arrangement, and this arrangement can prevent flicker on the display screen.

The above-described embodiment has employed the gray scale processing in the cycles of four and two frames. It should be noted, however, that the present invention is not limited to the four-frame cycle and/or two-frame cycle. For example, when the brightness level of input image data is greater than the predetermined level, the gray scale processing width may be two bits and the gray scale processing may be performed in the cycle of two frames, with a display brightness level being assigned every half a frame. On the other hand, when the brightness level of the input image data is equal to or less than the predetermined level, the gray scale processing width may be one bit and the gray scale processing may be carried out in the cycle of one frame. A display brightness level may be assigned every half a frame.

In the illustrated embodiment, when the brightness level of the input image data is equal to or less than the predetermined level, the gray scale processing width is one bit and the frequencies of selection of the immediately lower and higher display brightness levels are made equal to each other. That is, an immediately lower display brightness level and an immediately higher display brightness level are alternately selected every one frame. However, if no flicker occurs, then an immediately lower display brightness level and an immediately higher display brightness level may be alternately selected every two frames. To assign a display brightness level every half a frame as mentioned above, an immediately lower display brightness level and an immediately higher display brightness level may be alternately selected every one frame. When the brightness level of the input image data is equal to or less than the predetermined level, the frequencies of selection of the immediately lower and higher display brightness levels are equalized. It should be noted, however, that the invention is not limited to such implementation. For example, the frequencies of selection may be made closer to each other to such an extent as not to cause flicker.

In the above-described embodiment, when the desired brightness level (the brightness level of input image data) is equal to or less than the predetermined level, the number of pieces of image data (display image data) of the same brightness level to be successively displayed in a predetermined period is adjusted to be less than a pre-defined value. That is, in the above-described embodiment, when the brightness level of input image data is equal to or less than the predetermined level, the gray scale processing width is set to one bit. Then, alternate selections are made between the first image data (the display image data indicative of an immediately lower display brightness level) with the first display brightness level lower in brightness than the desired brightness level in one-frame cycles and the second image data (the display image data indicative of an immediately higher display brightness level) with the second display brightness level higher in brightness than the desired brightness level. Accordingly, the pre-defined value is one, with the number of pieces of display image data of the same brightness level being one. It should be noted, however, that the pre-defined value may be greater than one depending on the duration of the predetermined period (the four-frame period in the above-described embodiment).

Although the input image data is 8-bit data in the above-described embodiment, data of other than eight bits may be employed. In the 8-bit image data, the brightness level following the decimal point is represented in two bits in the illustrated embodiment, but it may also be represented in three or more bits.

In the illustrated embodiment, the gray scale processing circuit 11 is provided in the form of hardware; however, it may be implemented in the form of software or combination of hardware and software. Specifically the processing of the gray scale processing circuit 11 may be carried out by a computer that executes various steps and commands defined by software instructions.

This application is based on Japanese Patent Application No. 2010-265008 filed on Nov. 29, 2010 and the entire disclosure thereof is incorporated herein by reference.

What is claimed is:

1. A display device comprising:

a gray scale processor which successively displays two or more pieces of image data having different brightness levels in a predetermined order on a display panel during a predetermined period, thereby displaying in a pseudo manner a brightness corresponding to a desired brightness level represented by input image data;

a detector for detecting whether the desired brightness level is equal to or less than a predetermined level; and a gray scale controller for adjusting the number of successively displayed pieces of image data of the same brightness level to or less than a pre-defined value when the desired brightness level is equal to or less than the predetermined level, wherein the input image data is displayed in a pseudo manner using first image data of a first display brightness level lower in brightness than the desired brightness level and second image data of a second display brightness level higher in brightness than the desired brightness level, and when the brightness level of the input image data is equal to or less than the predetermined level, the gray scale controller displays the first image data and the second image data alternately on the display panel for the predetermined period.

2. The display device according to claim 1, wherein the input image data is made up of a plurality of bits, the plurality of bits including a first group of bits following a decimal point and a second group of bits preceding the decimal point, and the gray scale controller comprises:

a gray scale pattern generator for generating gray scale pattern data corresponding to a value represented by the first group of bits when the desired brightness level is greater than the predetermined level, and for generating gray scale pattern data having a value 0 and 1 alternately for every said predetermined period when the desired brightness level is less than the predetermined level, and an adder for adding the value of the gray scale pattern data to the second group of bits of the input image data to generate the image data.

3. The display device according to claim 1, wherein the detector and the gray scale controller are integrated in one semiconductor chip.

4. The display device according to claim 1, wherein the image data is indicative of a still image.

5. A method of gray scale processing, for successively displaying two or more pieces of image data having different brightness levels in a predetermined order on a display panel during a predetermined period, thereby displaying in a pseudo manner a brightness corresponding to a desired brightness level, the method comprising:

determining whether the desired brightness level is equal to or less than a predetermined level;

adjusting the number of successively displayed pieces of image data at the same brightness level to or less than a pre-defined value when the desired brightness level is equal to or less than the predetermined level; and displaying first image data and second image data alternately on the display panel for the predetermined period when the brightness level of the input image data is equal to or less than the predetermined level, so as to display the input image data in a pseudo manner using the first image data and the second image data, the first image data being image data of a first display brightness level lower in brightness than the desired brightness level and the second image data being image data of a second display brightness level higher in brightness than the desired brightness level.

6. The method according to claim 5, wherein the input image data is made up of a plurality of bits, the plurality of bits including a first group of bits following a decimal point and a second group of bits preceding the decimal point, and the method further comprises:

generating gray scale pattern data corresponding to a value represented by the first group of bits when the desired brightness level is greater than the predetermined level;

generating gray scale pattern data having a value 0 and 1 alternately for every said predetermined period when the desired brightness level is less than the predetermined level; and adding the value of the gray scale pattern data to the second group of bits of the input image data to generate the image data.

7. The method according to claim 5, wherein the image data is indicative of a still image.

8. A display device for displaying on a display panel an image corresponding to input image data by selecting in predetermined cycles either one of an immediately lower display brightness level than a brightness level represented by the image data or an immediately higher display brightness level, among a plurality of display brightness levels arranged at equal intervals for each pixel of the display panel, and driving the display panel at the selected display brightness levels, thereby performing gray scale processing so that the brightness level represented by the image data is produced in a pseudo manner, the display device comprising:

a detector for detecting that the brightness level represented by the image data is equal to or less than a predetermined level and other than the plurality of display brightness levels; and a gray scale controller for making frequencies of selection of the immediately lower display brightness level and the immediately higher display brightness level closer to each other so that the selected display brightness levels do not remain at the same display brightness level for a period greater than the predetermined cycle when the brightness level represented by the image data is equal to or less than the predetermined level and other than the plurality of display brightness levels, wherein the gray scale controller alternately selects at the predetermined cycles between the immediately lower display brightness level and the immediately higher display brightness level when a brightness level represented by the image data is equal to or less than the predetermined level and other than the plurality of display brightness levels.

9. The display device according to claim 8, wherein the gray scale controller includes:

a gray scale pattern generator for generating, when a brightness level represented by the image data made up of a plurality of bits is greater than the predetermined level, one-bit gray scale pattern data at a predetermined multiple of the predetermined cycle corresponding to a value of a plurality of lower bits of the image data, and for generating, when the brightness level represented by the image data is equal to or less than the predetermined level and other than the plurality of display brightness levels, the one-bit gray scale pattern data having a value of 0 and a value of 1 alternately at the predetermined cycles, and an adder for adding the value of the gray scale pattern data to a value of the remaining bits excluding the plurality of lower bits of the image data, wherein a level represented by a result of addition provided by the adder is the selected display brightness level.

10. The display device according to claim 8, wherein a brightness level represented by the image data is produced by four frames in a pseudo manner when the predetermined cycle is a period equivalent to one frame of the image data, and the period greater than the predetermined cycle is two frames.

11. The display device according to claim 9, wherein the predetermined multiple of the predetermined cycle is four frames when the predetermined cycle is a period equivalent to one frame of the image data.

12. The display device according to claim 8, wherein the detector and the gray scale controller are integrated in one semiconductor chip.

13. The display device according to claim 8, wherein the detector and the gray scale controller are integrated in one semiconductor chip together with a source driver or with the source driver and a scanner circuit.

14. The display device according to claim 8, wherein the image data is indicative of a still image.

15. A gray scale processing circuit for displaying an image corresponding to input image data on a display panel by selecting in predetermined cycles either an immediately lower display brightness level than a brightness level represented by the image data or an immediately higher display brightness level, among a plurality of display brightness levels defined at equal intervals, for each pixel of the display panel, thereby producing the brightness level represented by the image data in a pseudo manner, the gray scale processing circuit comprising:

a detector for detecting that the brightness level represented by the image data is equal to or less than a predetermined level and other than the plurality of display brightness levels; and a gray scale controller for making frequencies of selection of the immediately lower display brightness level and the immediately higher display brightness level closer to each other so as to prevent the selected display brightness levels from continuing not at the same display brightness level for a period greater than the predetermined cycle when the brightness level represented by the image data is equal to or less than the predetermined level and other than the plurality of display brightness levels, wherein the gray scale controller alternately selects at the predetermined cycles between the immediately lower display brightness level and the immediately higher display brightness level when a brightness level represented by the image data is equal to or less than the predetermined level and other than the plurality of display brightness levels.

16. A method of gray scale processing to display an image corresponding to input image data on a display panel of a display device by selecting in predetermined cycles either an immediately lower display brightness level than the brightness level represented by the input image data or an immediately higher display brightness level, among a plurality of display brightness levels defined at equal intervals, for each pixel of the display panel, and driving the display panel at the selected display brightness levels to obtain the brightness level represented by the image data in a pseudo manner, the method comprising:

detecting that the brightness level represented by the image data is equal to or less than a predetermined level and other than the plurality of display brightness levels;

making frequencies of selection of the immediately lower display brightness level and the immediately higher display brightness level closer to each other, so as to prevent the selected display brightness levels from continuing at the same display brightness level for a period greater than the predetermined cycle when the brightness level represented by the image data is equal to or less than the predetermined level and other than the plurality of display brightness levels; and alternately selecting at the predetermined cycles between the immediately lower display brightness level and the immediately higher display brightness level when a brightness level represented by the image data is equal to or less than the predetermined level and other than the plurality of display brightness levels.

17. The display device according to claim 1, wherein the gray scale controller selects an appropriate bit number that represents a gray scale processing width, based on a detection result of the detector.

18. The display device according to claim 17, wherein the appropriate bit number is one when the detection result of the detector indicates that the desired brightness level is equal to or less than the predetermined level, and the appropriate bit number is two when the detection result of the detector indicates that the desired brightness level is greater than the predetermined level.

19. The display device according to claim 1, wherein the gray scale controller selects an appropriate frame number of a gray scale pattern data, based on a detection result of the detector.

20. The display device according to claim 19, wherein the appropriate frame number is two when the detection result of the detector indicates that the desired brightness level is equal to or less than the predetermined level, and the appropriate frame number is four when the detection result of the detector indicates that the desired brightness level is greater than the predetermined level.

* * * * *